US009168563B1

(12) United States Patent
Kalmon et al.

(10) Patent No.: US 9,168,563 B1
(45) Date of Patent: Oct. 27, 2015

(54) PAINT ROLLER FRAME WITH A BARBED CAGE

(71) Applicants: James A. Kalmon, New Castle, CO (US); Andrew McCleery, New Castle, CO (US); Guy Middleton, New Castle, CO (US)

(72) Inventors: James A. Kalmon, New Castle, CO (US); Andrew McCleery, New Castle, CO (US); Guy Middleton, New Castle, CO (US)

( * ) Notice: Subject to any disclaimer, the term of this patent is extended or adjusted under 35 U.S.C. 154(b) by 0 days.

(21) Appl. No.: 14/291,786

(22) Filed: May 30, 2014

(51) Int. Cl.
*B05C 17/02* (2006.01)

(52) U.S. Cl.
CPC ..... *B05C 17/02* (2013.01)

(58) Field of Classification Search
CPC B05C 17/02; B05C 17/0205; B05C 17/0217; B05C 17/0237
USPC ..... 15/230.11
See application file for complete search history.

(56) References Cited

U.S. PATENT DOCUMENTS

| | | | | |
|---|---|---|---|---|
| 3,986,226 | A | 10/1976 | Roe et al. | |
| 5,419,003 | A | 5/1995 | Tollasepp | |
| 5,598,598 | A | 2/1997 | Sorenson | |
| 6,553,605 | B2 * | 4/2003 | Kim | 15/230.11 |
| 6,655,746 | B1 * | 12/2003 | Weihrauch | 300/21 |

* cited by examiner

*Primary Examiner* — Laura C Guidotti
(74) *Attorney, Agent, or Firm* — Crossley Patent Law

(57) ABSTRACT

A paint roller frame with a barbed cage including elongated rods mounted to longitudinally between end members of a roller cage frame with protruding barbs that frictionally engaging an inner bore of a roller cover to prevent slippage of the roller cover from the roller cage frame.

1 Claim, 3 Drawing Sheets

PAINT ROLLER FRAME WITH A BARBED CAGE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of paint roller cages are known in the prior art; however, these paint roller cages are renowned for the propensity to permit slippage of a roller cover from the roller cage frame during usage. What is needed is a paint roller frame with a barbed cage including elongated rods mounted longitudinally between end members of a roller cage frame, the rods having protruding barbs that frictionally engage an inner bore of a roller cover to prevent slippage of the roller cover from the roller cage frame.

FIELD OF THE INVENTION

The present invention relates to paint roller cages, and more particularly, to a paint roller frame with a barbed cage.

SUMMARY OF THE INVENTION

The general purpose of the present paint roller frame with a barbed cage, described subsequently in greater detail, is to provide a paint roller frame with a barbed cage which has many novel features that result in a paint roller frame with a barbed cage which is not anticipated, rendered obvious, suggested, or even implied by prior art, either alone or in combination thereof.

To accomplish this, the present paint roller frame with a barbed cage is devised to prevent slippage of a roller cover from a roller cage frame while painting, in contrast to known paint roller frames which permit slippage during use, while allowing the roller cover to be removed without difficulty. The present device includes a roller cage frame having a pair of end members comprising an outer end member and an inner end member. A plurality of elongated rod members is spaced from each other and extend laterally between the two end members. A plurality of spaced apart barbs protrudingly disposed along each of the rod members. Each of the barbs includes a base having an inside wall attached to the respective rod member and a tapered barbed prong disposed on the base. Each prong of each of the barbs is directed toward the inner end member. The barbs are configured to securingly engage an inner bore of a roller tube centrally disposed within a roller cover that slidingly engages the roller cage frame in a position surrounding the rod members.

Upon the securing engagement of the barbs to the inner bore of the roller tube centrally disposed within a roller cover, the barbs are configured to prevent the roller cover from sliding away from the cage frame. The barbs are formed along a length of each of the plurality of elongated rod members.

The barbs are arranged in a pair of circumferential columns along the roller cage frame on the rod members. A first column of the pair of circumferential columns is disposed proximal the outer end member and a second column of the pair of circumferential columns is disposed proximal the inner end member.

The device operationally engages a roller handle assembly that includes a handle, an axle extending longitudinally within the roller tube, and a connecting member configured to connect the axle transversely with respect to the handle. At least one bushing rotatably engages the axle proximal one of the end members.

Thus has been broadly outlined the more important features of the present paint roller frame with a barbed cage so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
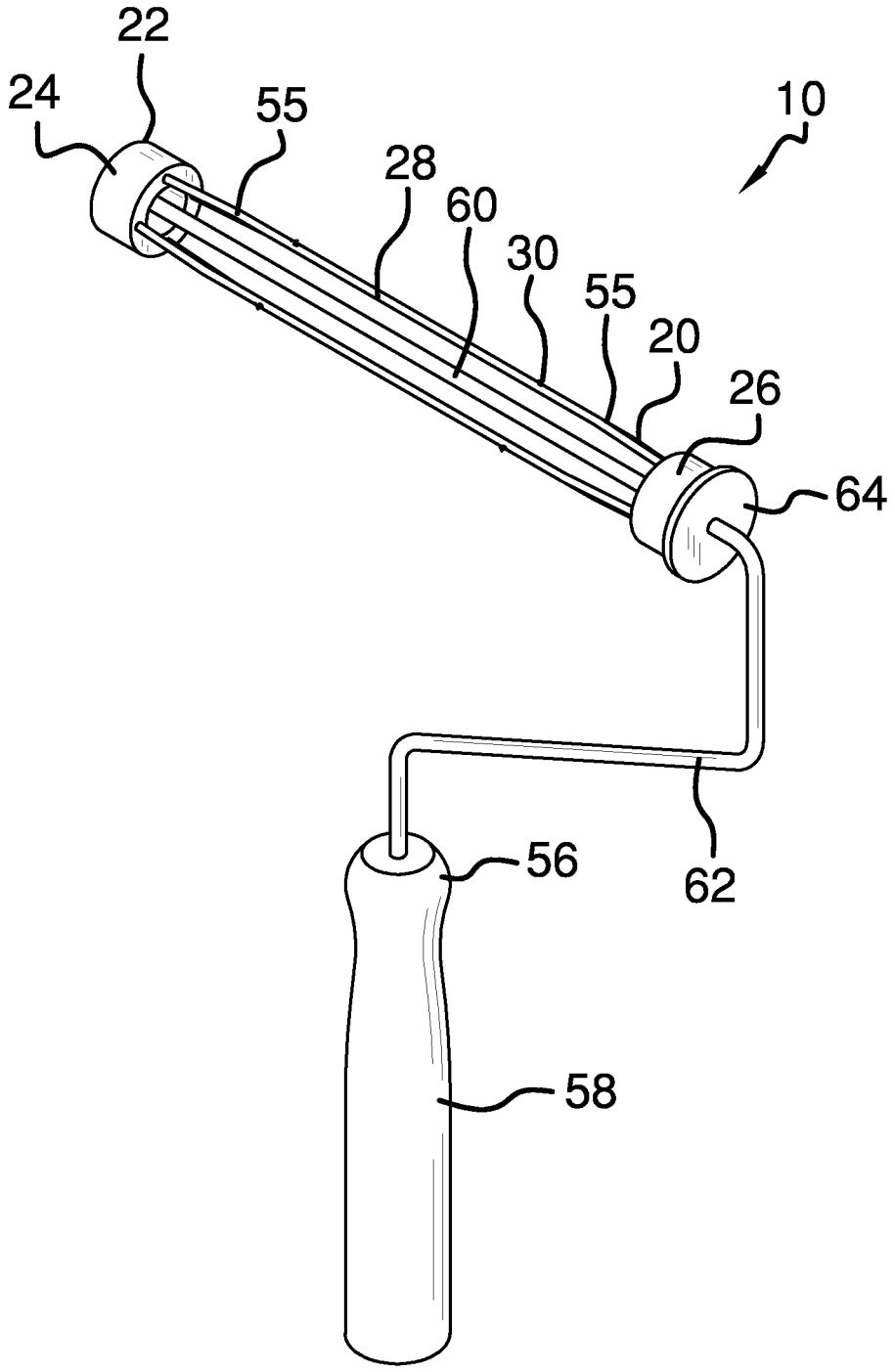
FIG. 1 is an isometric view.
Figure 2:
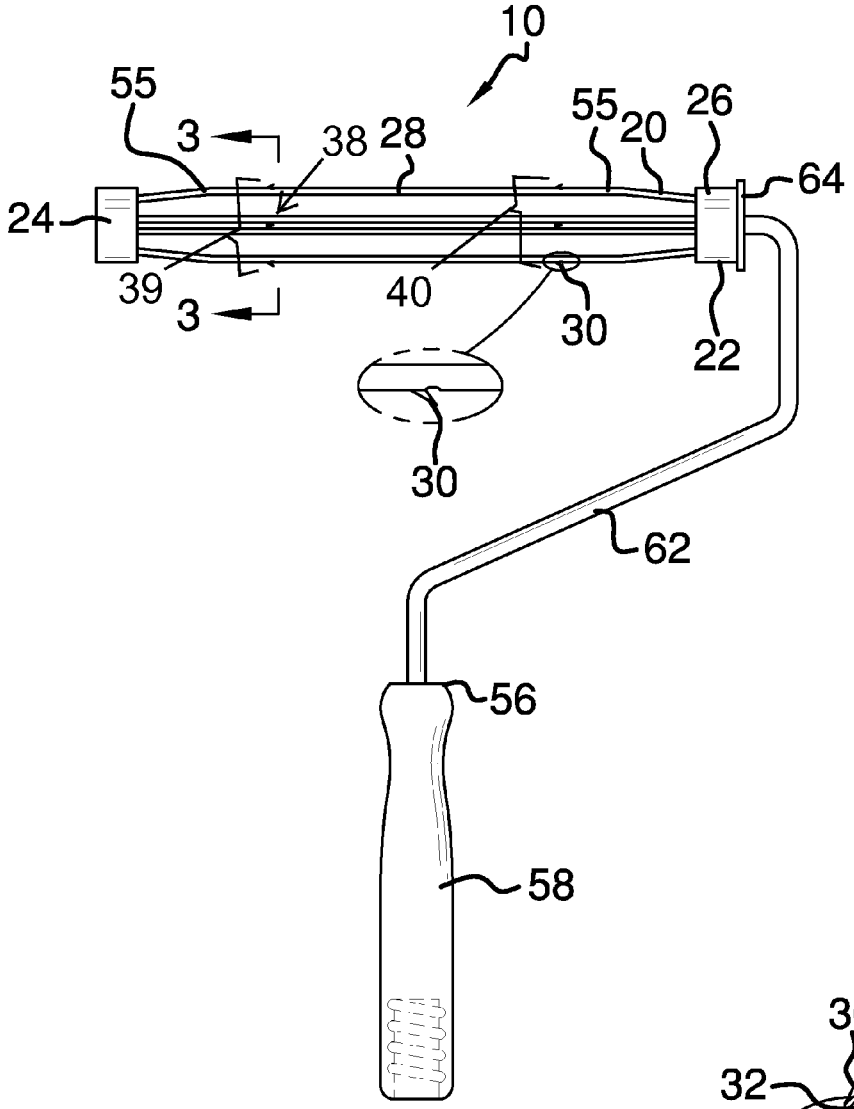
FIG. 2 is a side elevation view with an enlarged detail view of a barb.
Figure 3:
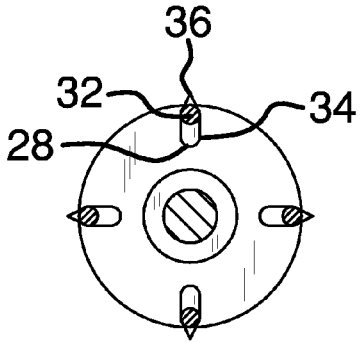
FIG. 3 is a cross-sectional view taken along line 3-3 of FIG. 2.
Figure 4:
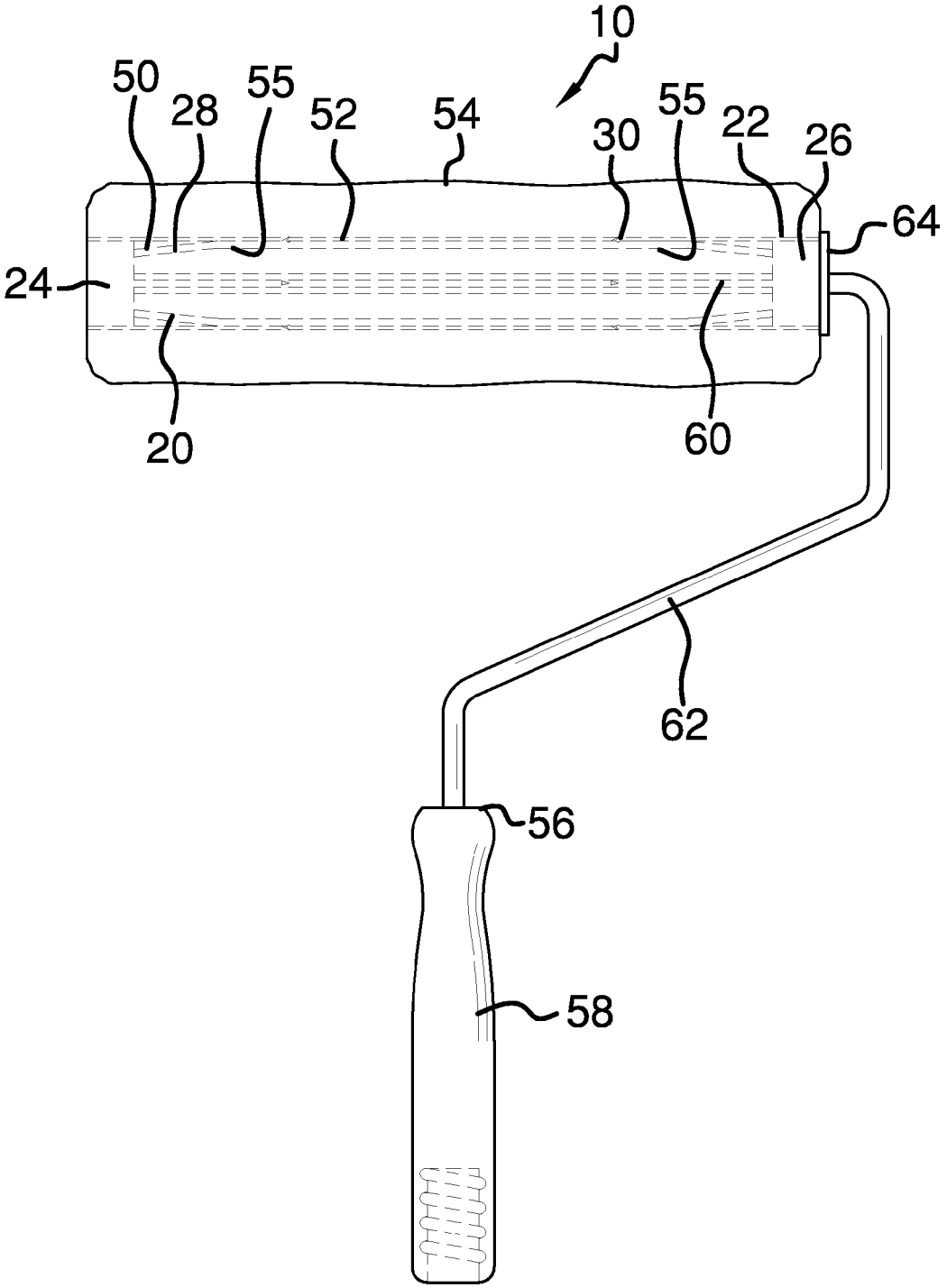
FIG. 4 is an in-use view shown inside a roller cover.

With reference now to the drawings, and in particular FIGS. 1 through 4 thereof, an example of the instant paint roller frame with a barbed cage employing the principles and concepts of the present paint roller frame with a barbed cage and generally designated by the reference number 10 will be described.

Referring to FIGS. 1 through 4 the present paint roller frame with a barbed cage 10 is illustrated. The paint roller frame with a barbed cage 10 includes a roller cage frame 20. The roller cage frame 20 includes a pair of end members 22 comprising an outer end member 24 and an inner end member 26. A plurality of elongated rod members 28 are spaced from each other and extend laterally between the two end members 22. A plurality of spaced apart barbs 30 are protrudingly disposed along each of the rod members 28. Each of the barbs 30 includes a base 32 having an inside wall 34 attached to the respective rod member 28 and a tapered barbed prong 36 disposed on the base 32. Each prong 36 of each of the barbs 30 is directed toward the inner end member 26.

The barbs 30 are configured to frictionally engage an inner bore 50 of a roller tube 52 centrally disposed within a roller cover that slidingly engages the roller cage frame 20 in a position surrounding the rod members 28.

Upon the securing engagement of the barbs 30 to the inner bore of the roller tube 52 centrally disposed within a roller cover 54, the barbs 30 are configured to prevent the roller cover 54 from sliding away from the cage frame 20. The barbs 30 are formed along a length of each of the plurality of elongated rod members 28. The barbs 30 are arranged in a pair of circumferential columns 38 along the roller cage frame 20 on the rod members 28. A first column 39 of the pair of circumferential columns 38 is disposed proximal the outer end member 24 and a second column 40 of the pair of circumferential columns 38 is disposed proximal the inner end member 26. The barbs 30 of the first column 39 on each rod member 28 are disposed between a center of the rod member

28 and 1 inch inwardly from a bend 55 in the rod member 28 proximal the outer end member 24 and wherein the barbs 30 of the second column 40 on each rod member 28 are disposed between the center of the rod member 28 and 1 inch inwardly from a bend 55 in the rod member 28 proximal the inner end member 26.

The device 10 operationally engages a roller handle assembly 56 that includes a handle 58, an axle 60 extending longitudinally within the roller tube 52, and a connecting member 62 configured to connect the axle 60 transversely with respect to the handle 58. At least one bushing 64 rotatably engages the axle 60 proximal one of the end members 22.

What is claimed is:

1. A paint roller frame with a barbed cage consisting of:

a roller cage frame comprising:

a pair of end members comprising an outer end member and an inner end member;

a plurality of elongated rod members spaced from each other and extending laterally between the two end members;

a sole pair of spaced apart barbs protrudingly disposed along each of the rod members;

wherein the barbs on the rod members are configured to frictionally engage an inner bore of a roller tube centrally disposed within a roller cover, the roller cover slidingly engaging the roller cage frame in a position surrounding the rod members;

wherein upon the securing engagement of the barbs to the inner bore of the roller tube centrally disposed within a roller cover, the barbs are configured to prevent the roller cover from sliding away from the cage frame;

wherein each of the barbs comprises:

a base having an inside wall attached to the respective rod member; and a tapered barbed prong disposed on the base;

wherein the prong of each of the barbs is directed toward the inner end member;

wherein the barbs are formed along a length of each of the plurality of elongated rod members;

wherein the barbs are arranged only in a pair of circumferential columns along the roller cage frame on the rod members, wherein a first column of the pair of circumferential columns is disposed proximal the outer end member and a second column of the pair of circumferential columns is disposed proximal the inner end member;

wherein the barbs are spaced apart a substantially equal distance along each of the rod members;

wherein the barbs of the first column on each rod member are disposed between a center of the rod member and 1 inch inwardly from a bend in the rod member proximal the outer end member and wherein the barbs of the second column on each rod member are disposed between the center of the rod member and 1 inch inwardly from a bend in the rod member proximal the inner end member;

a roller handle assembly comprising:

a handle;

an axle extending within a continuous cavity formed in the roller tube along a longitudinal axis thereof, the axle having a first end and a second end;

a connecting member configured to connect the axle transversely with respect to the handle; and at least one bushing rotatably engaging the axle proximal one of the end members.

* * * * *